US005810068A

United States Patent [19]

Kato

[11] Patent Number: 5,810,068

[45] Date of Patent: Sep. 22, 1998

[54] PRESSURE DIE-CASTING APPARATUS FOR VEHICLE WHEEL

[75] Inventor: Takashi Kato, Kakegawa, Japan

[73] Assignee: Asahi Tec. Corporation, Shizuoka, Japan

[21] Appl. No.: 755,754

[22] Filed: Nov. 5, 1996

[30] Foreign Application Priority Data

| | | | |
|---|---|---|---|
| Mar. 6, 1995 | [JP] | Japan | 7-74515 |
| Mar. 6, 1995 | [JP] | Japan | 7-74516 |
| Mar. 6, 1995 | [JP] | Japan | 7-74517 |
| Mar. 6, 1995 | [JP] | Japan | 7-74518 |
| Mar. 6, 1995 | [JP] | Japan | 7-74519 |

[51] Int. Cl.[6] ..... B22D 17/00

[52] U.S. Cl. ..... 164/306; 164/342; 164/134

[58] Field of Search ..... 164/306, 119, 164/342, 134

[56] References Cited

U.S. PATENT DOCUMENTS

| | | | |
|---|---|---|---|
| 5,314,001 | 5/1994 | Hidaka et al. | 164/119 |

FOREIGN PATENT DOCUMENTS

| | | | |
|---|---|---|---|
| 57-25273 | 2/1982 | Japan . | |
| 1-237065 | 9/1989 | Japan . | |
| 1-237067 | 9/1989 | Japan . | |
| 3-60844 | 3/1991 | Japan . | |
| 3-124360 | 5/1991 | Japan | 164/306 |
| 4-200967 | 7/1992 | Japan . | |
| 5-24149 | 3/1993 | Japan . | |
| 5-185200 | 7/1993 | Japan . | |
| 6-312252 | 11/1994 | Japan . | |

*Primary Examiner*—Kuang Y. Lin
*Attorney, Agent, or Firm*—Muramatsu & Associates

[57] ABSTRACT

A pressure die-casting apparatus D for a vehicle wheel including a lateral die 30 slidably displaced and a molten metal feeding port 312 of said lateral die 30 of which center axis extends vertically relative to the slidable surface of said lateral die 30, characterized in that a strainer receiving chamber 72 is disposed at the contact surface between said molten metal feeding port 312 and said lateral die 30, and a trainer R is received in said strainer receiving chamber 72.

7 Claims, 11 Drawing Sheets

PRESSURE DIE-CASTING APPARATUS FOR VEHICLE WHEEL

This is a continuation of international application Ser. No. PCT/JP96/00514, filed Mar. 5, 1996.

The present invention relates to mainly, a pressure die-casting apparatus for a vehicle wheel. Here, the pressure die-casting apparatus refers to a casting apparatus to which molten metal is fed using gas pressure. It should be noted that concrete description and description of a preferred embodiment made hereinafter is concerned with a low pressure die-casting apparatus. Here, low pressure refers to pressure of, e.g., 2 kg/cm$^2$ or less.

BACKGROUND ART

Since a molten metal feeding pipe stands substantially upright in a low pressure die-casting apparatus from the view point of structure, in the case of the low pressure die-casting apparatus for a vehicle wheel including a gate at a rim portion, a runner extending from the molten metal feeding pipe should be bent at a substantially right angle. For this reasons, as shown in FIG. 1 illustrating a conventional low pressure die-casting apparatus, a flow passage changing die C is interposed between a runner 301 substantially horizontally extending from a lateral die 30 and a molten metal feeding pipe 70 so that molten is poured in a cavity 50 by feeding the molten metal to the runner 301 of the lateral die 30 while flowing of the molten metal from the molten metal feeding pipe 70 is changed. In FIG. 1, reference number 302 denotes a parting surface of the lateral die 30.

However, with the conventional low pressure die-casting apparatus for a vehicle wheel constructed in that way, since the flow passage changing die C is positioned in a high pressure region in spite of the fact that it is disposed integrally with an upper die 40, there is a danger that molten metal invades in a small gap, resulting in a squeezing pin 92 failing to be disposed in the low pressure die-casting apparatus. Thus, a casting product can be disconnected from the upper die 40 with the aid of a squeezing member 93 after the lateral die 30 is disconnected from the low pressure die-casting apparatus (the lateral die is opened in and out of the plane of the drawing) but disconnection of the cast product from the flow passage changing die C unavoidably relies on gravity force. Thus, a first drawback of the conventional low pressure die-casting apparatus is that a rim portion (of the cast product) is undesirably distorted at a gate 311, causing the cast product to be readily bent.

In addition, a strainer in the conventional casting apparatus is interposed between the molten metal feeding pipe and a sprue in the casting die so as to filter the molten metal fed from the molten metal feeding pipe to the casting die.

However, since the strainer is disposed at the foremost end of the molten metal feeding pipe, in the case that the molten metal feeding pipe is arranged such that its center axis stands upright at a right angle relative to the sliding surface of the casting die adapted to be slidably opened or closed, the strainer becomes an obstacle when the casting die is slidably displaced. Thus, a second drawback of the conventional low pressure die-casting apparatus is that it is difficult that the casting die is adequately opened and closed.

With this kind of conventional low pressure die-casting apparatus, molten metal is fed to a cavity (casting space) via a runner space, and the cast product is disconnected from the casting die at the same time that the cast product is solidified in the cavity.

Additionally, a third drawback of the conventional low pressure die-casting apparatus is that since the runner is not still completely solidified in spite of the fact that cast product is solidified when the cast product is disconnected from the casting die, the runner is entangled or engaged with a base board or the like, causing it to be torn, and the torn runner is liable to remain in the molten metal feeding pipe.

Further, with the conventional low pressure die-casting method, the temperature retaining property of a dead head is maintained by forming the dead head forming space from a plurality of dead head space constructing members, and a gap is formed between the dead head constructing members so that degassing is achieved from this gap (refer to Japanese Laid-Open Patent Publication NO. 3-60844). However, a fourth drawback of the conventional low pressure die-casting method is that it is difficult that the temperature retaining property of the dead head and an efficiency of the degassing are improved.

Moreover, this kind of conventional low pressure die-casting apparatus includes double annular cooling means at the part constituting a disc forming portion and a spoke forming portion in the low pressure molding die so as to allow the foregoing part to be cooled.

However, with the conventional low pressure die-casting apparatus, since the double annular cooling means are simultaneously actuated, i.e., simultaneously cooled, a fifth drawback of the conventional low pressure die-casting apparatus is that sufficient directional solidification orienting form the disc portion in the radial direction or that sufficient directional solidification orienting from the spoke portion to the disc portion can not be obtained.

A first object of the present invention is to eliminate the aforementioned first drawback.

A second object of the present invention is eliminate the aforementioned second drawback.

A third object of the present invention is to eliminate the aforementioned third drawback.

A fourth object of the present invention is to eliminate the aforementioned fourth drawback.

A fifth object of the present invention is to eliminate the aforementioned fifth drawback.

DISCLOSURE OF THE INVENTION

To accomplish the first object, according to the first invention, there is provided a pressure die-casting apparatus for a vehicle wheel including a lateral die by which a rim forming portion is constructed and a molten metal feeding pipe is located below the lateral die while standing substantially upright, wherein a flow passage changing runner is formed on the lateral die, one end of the runner is opened at a rim forming portion of the cavity to serve as a gate, and the other end of the runner is opened at the lower surface of the lateral die so that the molten metal feeding pipe is communicated with the opening portion at the lower surface of the lateral die. Thus, since the flow passage changing runner for the molten metal is formed in the lateral die, when the lateral die is disconnected from a cast product, the flow passage changing portion can be disconnected from the cast product. Thus, when the pressure die-casting apparatus for a vehicle wheel constructed according to the first invention is used, no distortion is caused between the gate and the rim portion when the upper die is disconnected from the cast product after the lateral die is disconnected from the same in spite of the fact that the gate is disposed on the lateral die constructing the rim. As a result, bending of the rim portion (of the cast product) at the time of disconnection of the rim portion can be prevented. As a result that the runner is disposed on the vertically split die, it is possible that the casting die is split in more than three directions (the lateral die is split in at least in two, for example, the leftward/rightward direction, and the lower die is split in the downward direction), and moreover, the runner can be disposed on the lateral die.

To accomplish the second object, according to the second invention, there is provided a pressure die-casting apparatus for a vehicle wheel including a lateral die slidably displaced and a molten metal feeding port of the lateral die of which center axis extends vertically relative to the slidable surface of the lateral die, wherein a strainer receiving chamber is disposed at the contact surface between the molten metal feeding port and the lateral die, and a strainer is received in the strainer receiving chamber without obstructing sliding displacement of the lateral die.

With the pressure die-casting apparatus constructed according to the second invention, since the strainer communicated with the molten metal feeding port does not obstruct slidable displacement of the lateral die in spite of the fact that the center axis of the molten metal feeding port is arranged vertically relative to the slidable surface of the lateral die, adequate slidable displacement of the lateral die can be assured. Because the runner is formed between the lateral dies, the casting die can easily be split in four directions; two lateral dies, an upper die and a lower die.

To accomplish the third object, according to the third invention (only this invention contains not only a pressure die-casting apparatus but also a gravity casting apparatus, etc. all the other casting apparatus), there is provided a pressure die-casting apparatus for a vehicle wheel including a plurality of lateral dies by which a runner space is formed, wherein a rib forming space is formed in association with the runner space, and the rib forming space is formed on a parting surface of the lateral die. With this construction, since the rib has smaller thickness than the runner, the rib filled with molten metal is solidified faster than the runner, and moreover, serves not only to reinforce the runner in which molten metal is not completely solidified but also as a cooling fin. Therefore, when the pressure die-casting apparatus constructed according to the third invention is used, when the lateral die is disconnected while the rib is solidified, the runner is reinforced by the rib. Thus, even though the molten metal of the runner is not completely solidified, there does not arise a malfunction that the runner is entangled or engaged with a base board or the like to be torn, causing the torn runner to remain in the molten metal feeding pipe.

When an auxiliary space having a substantially circular sectional shape is disposed along the foremost end edge of the rib forming space and it is formed on the parting surface of the lateral die, the flowing of the molten metal which invades in the auxiliary space can be decelerated. Thus, leakage of the molten metal from the parting surface can reliably be prevented.

To accomplish the fourth object, according to the fourth invention, there is provided a pressure die-casting apparatus for a vehicle wheel including a dead head forming space communicated with a cavity and a plurality of dead head space constructing members superimposed one above another in the dead head space while forming a gap between the dead head space constructing members, wherein the width of the gap is set to the range of about 0.03 to 0.7 mm. With this construction, when the molten metal is fed, degassing from the cavity can be achieved at a high efficiency. Since the dead head constructing members are designed in a ring-like contour, the total thermal capacity can be reduced, resulting in the temperature of the dead head being efficiently maintained.

Thus, cast products each having no casting flaws can be provided by pressure die-casting.

To accomplish the fifth object, according to the fifth invention, there is provided a pressure die-casting apparatus for a vehicle wheel wherein a casting die includes a disc forming portion, a spoke forming portion and a rim forming portion, and a gate is disposed at the part of the casting die constructing the rim forming portion, first cooling means is disposed at the part of the casting die constructing the disc forming part, second cooling portion is disposed at the part of the casting die constructing the spoke forming section, and cooling control means is arranged for controlling both the cooling means, wherein the cooling control means activates the second cooling means after the first cooling means is activated (or before the first cooling means is activated). Thus, the molten metal filled in the cavity is radially cooled from the disc portion which is formed in the disc forming portion toward the spoke portion which is formed in the spoke forming portion, or the molten metal is cooled from said spoke portion toward said disc portion. Consequently, when the pressure die-casting apparatus for a vehicle wheel constructed according to the fifth invention is used, a vehicle wheel having more complete directional solidification (directional solidification radially orienting from the disc portion to the spoke portion or directional solidification orienting from the spoke portion to the disc portion) than that of conventional casting apparatus can be cast.

BRIEF DESCRIPTION OF THE DRAWINGS

FIG. 4-1 is a sectional view of a pressure die-casting apparatus according to a third invention.

FIG. 4-2 is an enlarged sectional view of IV-II section shown in FIG. 4-1.

BEST MODE FOR CARRYING OUT THE INVENTION

The present invention will be described in detail hereinafter with reference to accompanying drawings which illustrate an embodiment of a low pressure die-casting apparatus for a vehicle wheel.

Figure 1:
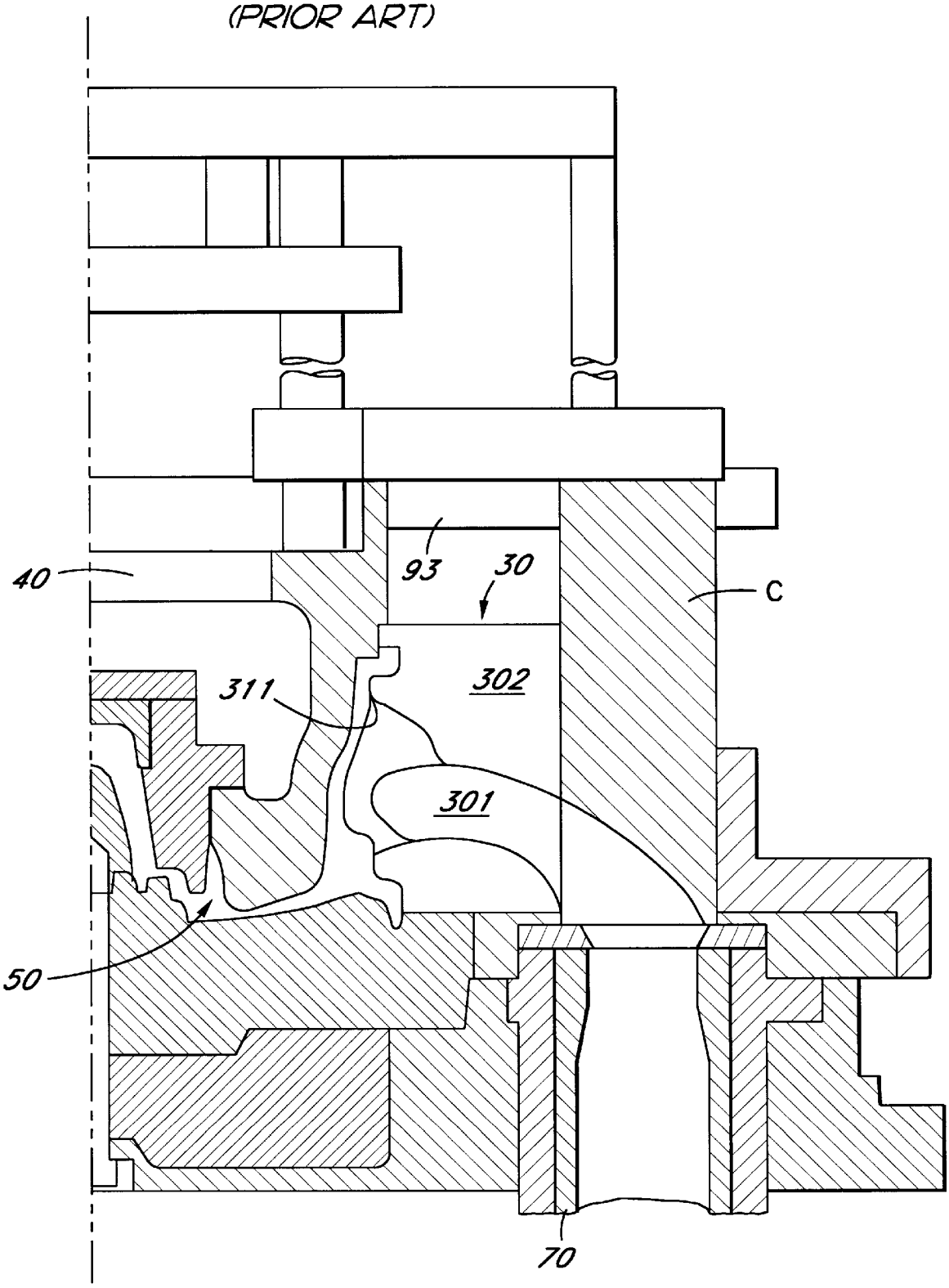
FIG. 1 (PRIOR ART)
FIG. 1 is fragmentary sectional view of a conventional pressure die-casting apparatus for a vehicle wheel.
Figure 2:
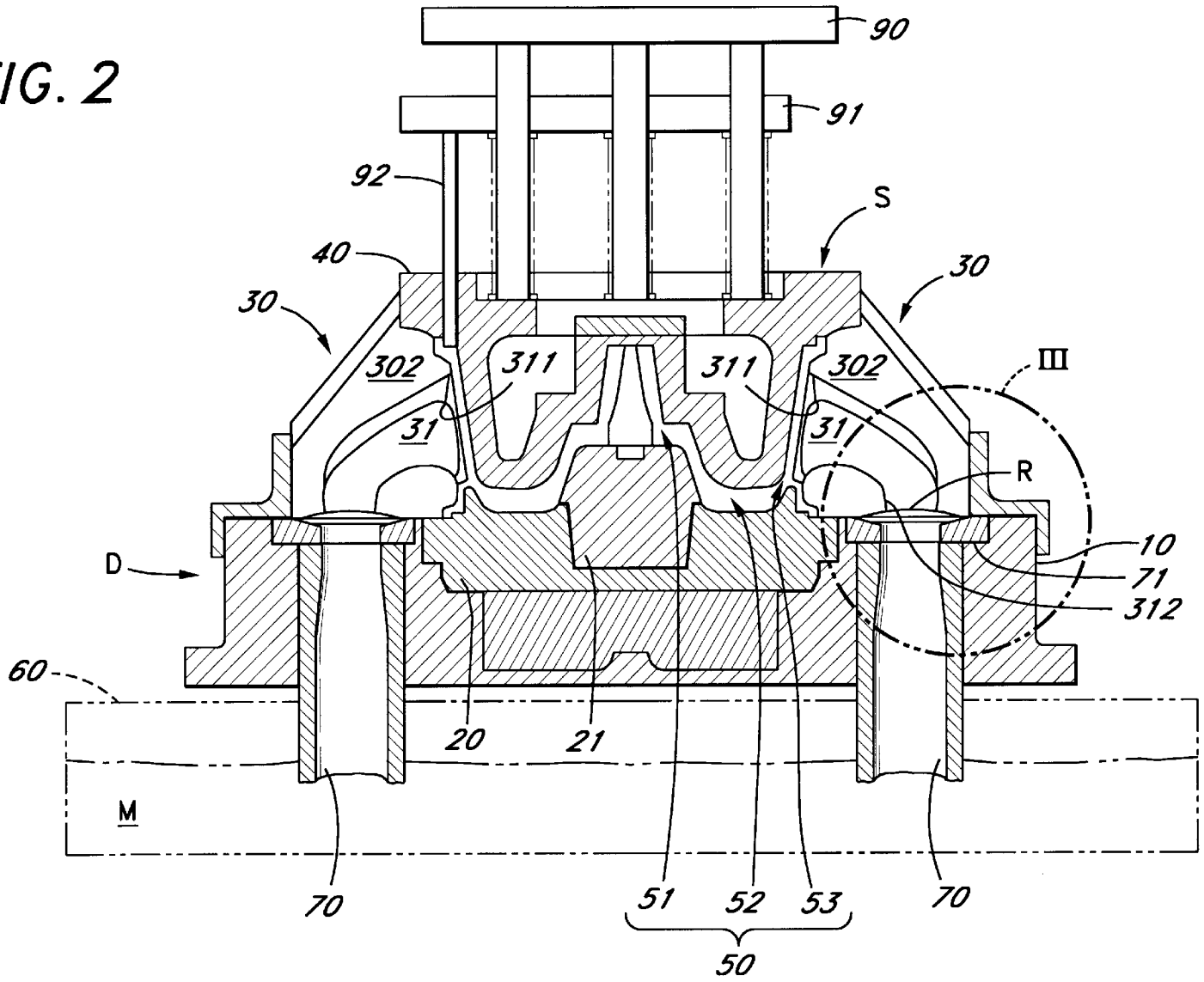
FIG. 2 is a sectional view of a pressure die-casting apparatus for a vehicle wheel constructed not only according to a first invention bust also according to a second invention.
Figure 3:
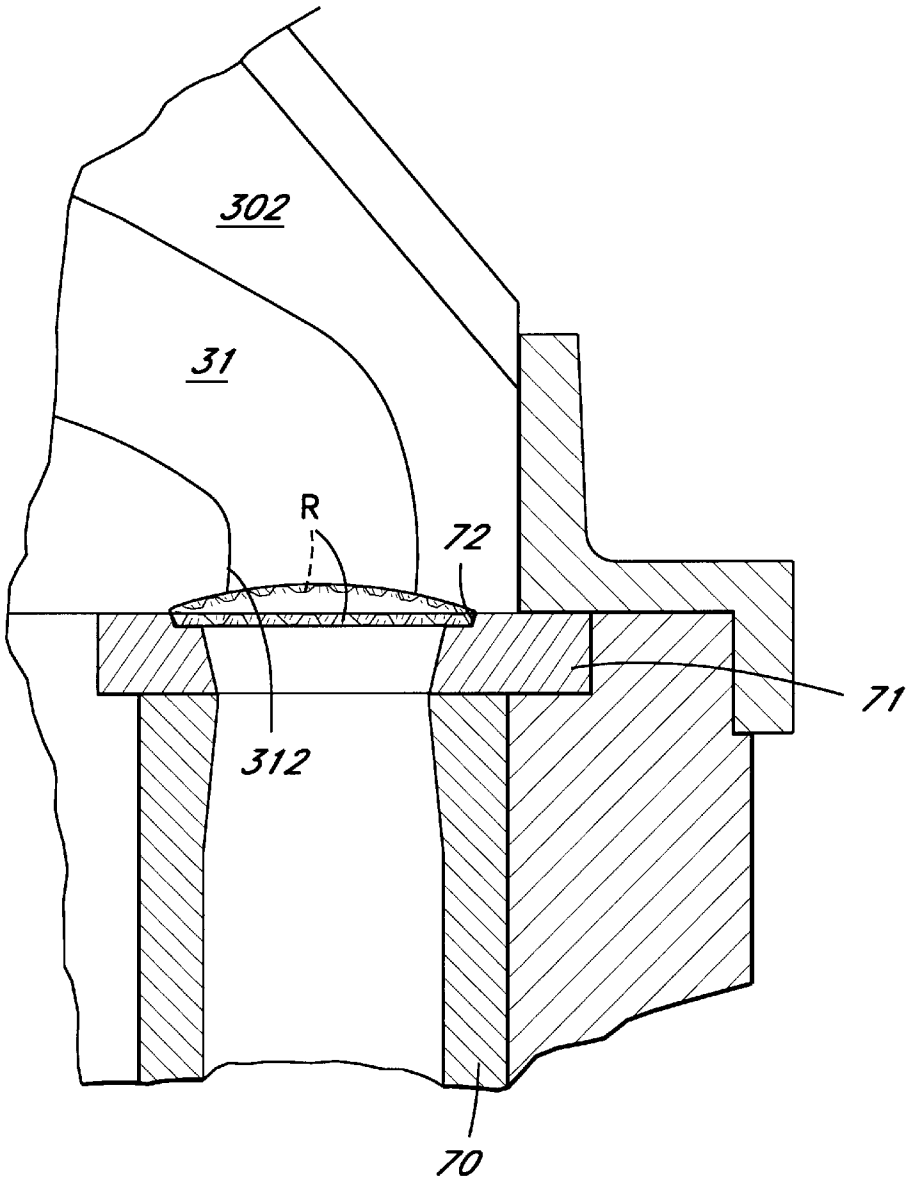
FIG. 3 is an enlarged sectional view of III section shown in FIG. 2.

FIG. 2 and FIG. 3 are sectional views which show the structure of the low pressure die-casting apparatus constructed not only according to the first invention but also according to the second invention.

In FIG. 2, reference numeral 10 designates a base board for a low pressure die-casting apparatus D. A casting die set S for forming a vehicle wheel is placed on the base board 10. This die mold set S is composed of a lower die 20, a pair of lateral dies 30, and an upper die 40. Here, the lateral die refers to a die adapted to be displaced in a plane perpendicularly intersecting the axis center of a molten metal feeding pipe 70 to be described later. Reference number 50 designates a cavity which is defined by the casting die set S. The cavity 50 exhibits a vehicle wheel-like contour, and is composed of a disc forming portion 51, a spoke forming portion 52 and a rim forming portion 53. In FIG. 2, reference numeral 21 denotes a core for the lower die 20 which defines the surface of a disc portion (of the vehicle wheel).

Reference numeral 31 denotes a space for a flow passage changing runner which is formed on a parting surface 302 of the lateral die 30. This runner space 31 exhibits a substantially L-shaped contour of which one end is opened at the rim forming portion 53 of the cavity 50 to construct a gate 311. In addition, the other end of the flow passage changing runner space 31 is communicated with an upper opening of the molten metal feeding pipe 70. With this construction, the molten metal M rising in the molten metal feeding pipe 70 is fed to the rim forming portion 53 via the flow passage changing space 31 of the lateral die 30.

Reference numeral 60 denotes a molten metal holding furnace which is arranged below the base board 10. A molten metal M is received in the molten metal holding furnace 60. Reference numeral 70 denotes a molten metal feeding pipe which stands substantially upright on the base board 10. The lower end of the molten metal feeding pipe 70 is opened in the molten metal holding furnace 60. As the molten metal M in the molten metal holding furnace 60 is pressurized, it rises in the molten metal feeding pipe 70 so that the cavity 50 is filled with the molten metal M. Incidentally, the flow passage extending form the molten metal feeding pipe 70 to the cavity 50 will be described later.

In FIG. 3, reference numeral 71 denotes a sprue collar which is placed on the upper end surface of the molten metal feeding pipe 70.

Reference numeral 72 denotes a recess disposed on the molten metal feeding pipe 70 side which serves as a strainer receiving chamber in the second invention. The recess 72 is formed in the upper end opening portion of the sprue collar 71. The recess 72 extends to the upper end opening of the sprue collar 71 and outside of the lower end opening of the flow passage changing runner 31. Otherwise, a recess may be formed on the lateral die 30 side so as to serve as a strainer receiving chamber.

Reference character R denotes a strainer which is received as if it is placed on the recess 72. Namely, a recess larger than the strainer R is formed on the sprue collar 71. The upper end opening portion of the sprue collar 71 corresponds to a "molten metal feeding port" in the second invention. Thus, the strainer R does not collide with the lateral die 30 when the lateral die 30 is slidably displaced in the horizontal direction (in and out of the plane of the page), and moreover, it does not drop in the molten metal feeding pipe 70. Even when the molten metal pressure is exerted on the strainer R, since it stands against the end edge of the lower opening of the flow passage changing runner 31 (refer to the state represented by the upwardly curved strainer), there does not appear a gap around the strainer R, whereby invasion of foreign material can be prevented, and moreover, a flexible strainer, e.g., a strainer made of glass fibers can be used. When a strainer made of a non-metallic material is used, it is not necessary that a return material is selected from other kind material. Thus, a treating efficiency of the return material can be improved.

Thus, the molten metal M rising in the molten metal feeding pipe 70 passes through the strainer R, and thereafter, it is fed to the rim forming portion 53 of the cavity 50 via the flow passage changing runner 31.

A retained portion of the strainer R is set to 25 to 40% relative to a net diameter. The reason why it is defined in that way consists in that when it is in excess of 40%, the material of the strainer is uselessly consumed, and when it is less than 25%, the strainer can not sufficiently be retained by the molten metal pressure.

Reference numeral 90 denotes an upper die actuating member which is fixed to the upper die 40. Thus, the upper die 40 can be displaced in the upward/downward direction by displacing the upper die actuating member 90 in the upward/downward direction. Reference numeral 91 denotes a squeezing plate, and reference numeral 92 denotes a squeezing pin which is fixed to the squeezing plate 91. The squeezing pin 92 extends through the upper die 40 and is exposed to the flange end (located in the upper position as seen in the drawing) of the rim forming portion 53 (of the cavity 50). With this construction, when only the squeezing pin 91 is lowered after the upper die 40 and the squeezing pin 92 are raised by actuating an upper die actuating device 80, a cast rim wheel is depressed with the foremost end of the squeezing pin 92, whereby the (cast) wheel is disconnected from the upper die 40.

A method of disconnecting a cast product from the pressure die-casting die device D will be described below.

After molten metal is solidified in the cavity 50, first, the pair of lateral dies 30 are disconnected from the casting die device D (the pressure die-casting device D is opened in and out of the plane of the page). At this time, the L-shaped runner (solidified molten metal) formed by the flow passage changing runner space 31 is separated from the lateral die 30. Thereafter, the upper die actuating member 90 is actuated to raise up the upper die 40 and the squeezing pin 92 together with the (cast) wheel, and the lower die 20 is disconnected from the base board 10 by gravity. While the foregoing state is maintained, only the squeezing pin 92 is lowered, and when the rim flange of the (cast) wheel is thrusted with the foremost end of the pin 92, the (cast) wheel is disconnected from the upper die 40.

With two split die (upper and lower dies), since the die can not be disassembled when a runner is disposed on the upper die, the runner is formed only on the surface of the lower die. With this construction, the gate portion has a reduced strength, and especially, in the case of a wheel, there remarkably appears a problem. Thus, when a gate is formed on the disc and an outer flange, the resultant wheel is not preferably acceptable as a cast product. On the contrary, according to the second invention, when gates are disposed at the position where strength is not required, the scope of selection is widened, and moreover, many gates can be formed on the wheel, resulting in a production efficiency being improved. Since the molten metal running distance is short when many gates are formed in that way, it is possible to allow the molten metal to run around the wheel. Thus, a productivity can be elevated.

Further, when a sprue is formed on the lateral die, a size of the sprue can freely be set, and the sprue can freely be enlarged without any restriction given by the cast product. On the other hand, in the case that a sprue is formed on the lower die, since a size of the sprue has an effect on the contour of the cast product, the size of the sprue is naturally restricted. As a result, it is difficult to improve the operational efficiency of a casting operation.

Figures 1, 4:
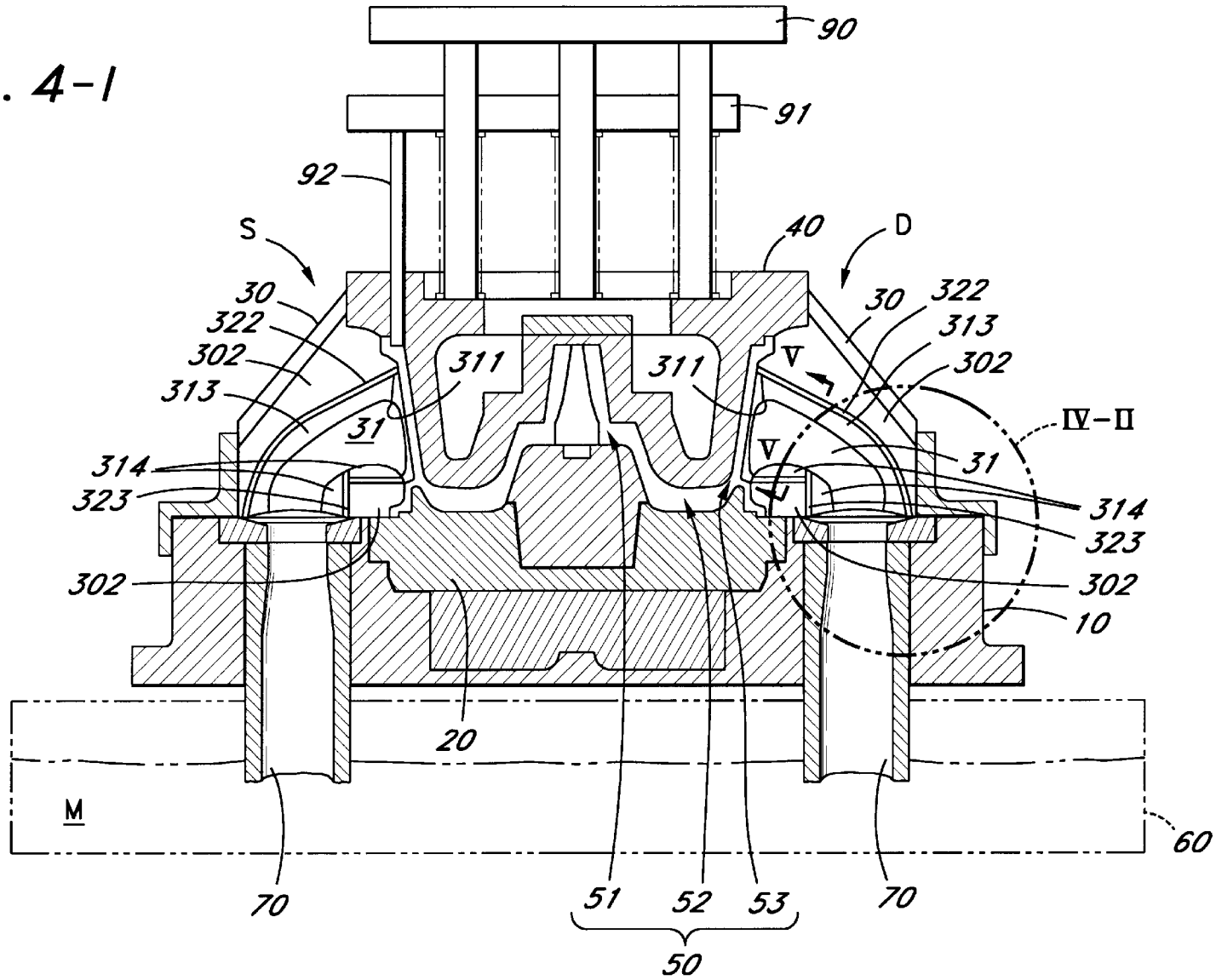
Figures 2, 4:
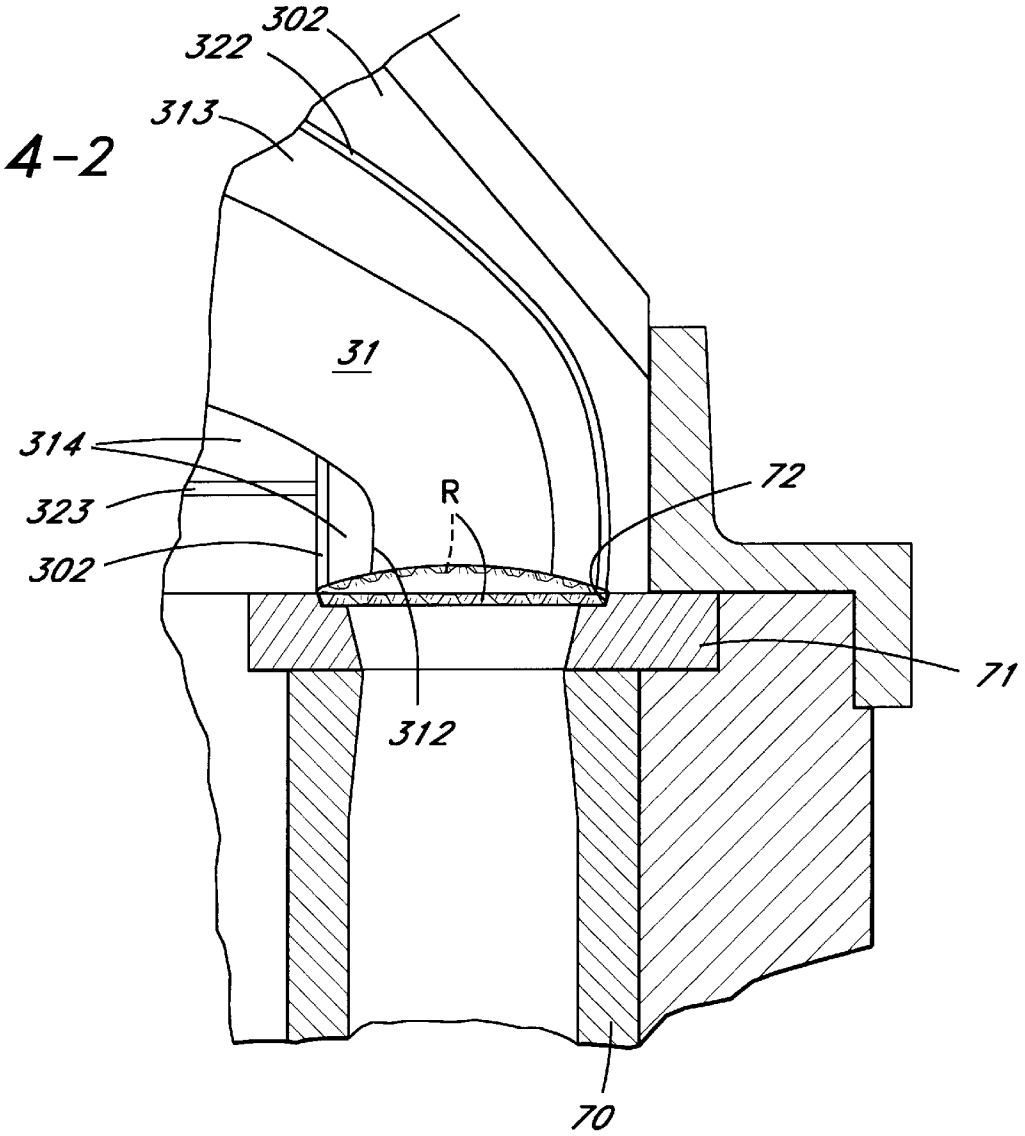
Figure 5:
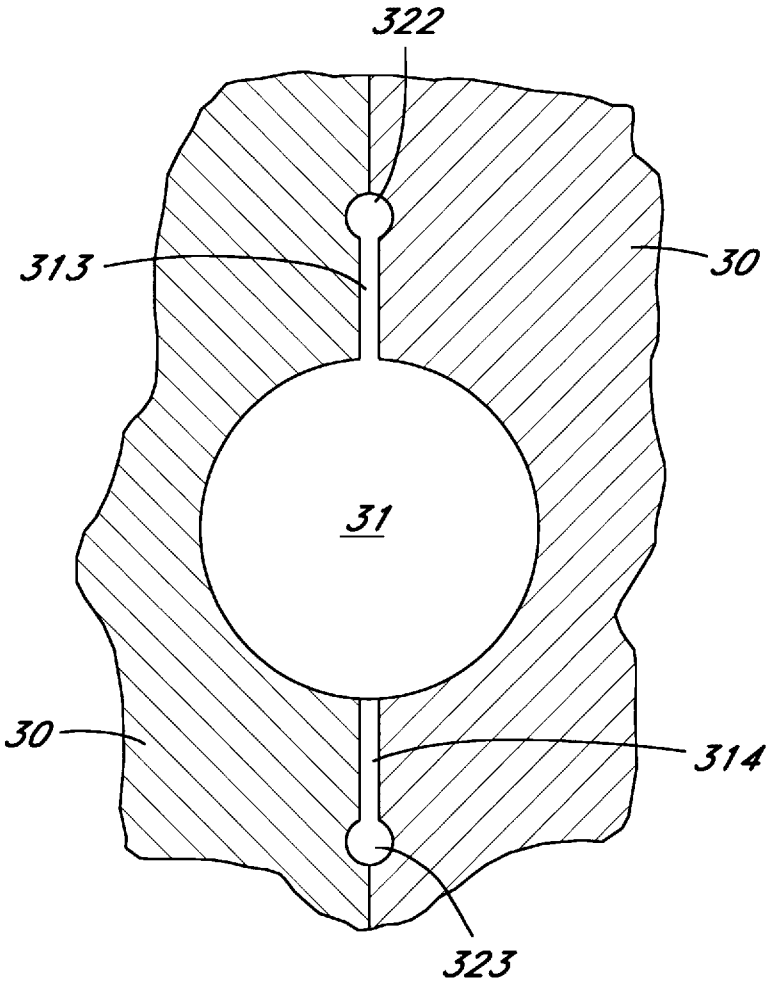
FIG. 5 is an enlarged sectional view taken along line V—V in FIG. 4.

FIG. 4, FIG. 4-2, and FIG. 5 show an embodiment of the low pressure die-casting apparatus constructed according to the third invention. Further, as described above, this invention is related to not only a pressure die-casting apparatus but also is applicable to all die-casting apparatus. However, on this, this invention will be described hereinafter with reference to an embodiment of a low pressure die-casting.

In FIG. 4, FIG. 4-2, and FIG. 5, reference numeral 313 denotes a space for forming a rib. The rib forming space is located on the parting surface 303 of the lateral die 30. The rib forming space 313, 314 is communicated with the flow passage changing runner space 31 so that a rib is formed along the flow passage changing runner (having molten metal solidified). The space for forming a rib 313, 314 extends from a lower opening portion 312 toward a gate 311. Further, the space for forming a rib 313,314 is formed at about a right angle with the flow passage changing runner space 31. Reference numeral 322, 323 designates an auxiliary space which is formed on the parting surface 302 of the lateral die 30. The auxiliary space 322, 323 is communicated along the foremost end edge of the rib forming space 313. The auxiliary space 322, 323 has a substantially circular sectional shape (refer to FIG. 5), causing the flow speed of the invaded molten metal M to be decelerated. Thus, leakage of the molten metal M from the adjacent lateral die 30 can be prevented. Leakage can be prevented by auxiliary spaces 322, 323 of partial lengths, as well.

A method of disconnecting a cast product from the pressure die-casting apparatus D is same as that of the first invention, but when die disconnection is effected while a rib is solidified by utilizing the fact that a rib (which is formed by the rib forming space 313, 314) is solidified faster than the runner, there does not arise a malfunction that since the runner is reinforced by the rib, the runner is entangled or engaged with the base board or the like, causing the runner to be torn, and the torn runner remains in the molten metal feeding pipe. It should be added that the rib functions as a cooling fin for the runner. The structure of the lateral dies 30 in the lower opening portion 312 which forms the ribs 313, 314 and auxiliary spaces 322, 323 contacts and presses the strainer R. FIG. 6 to FIG. 12 show an embodiment of a pressure die-casting apparatus for a vehicle wheel constructed according to the fourth invention.

Figure 6:
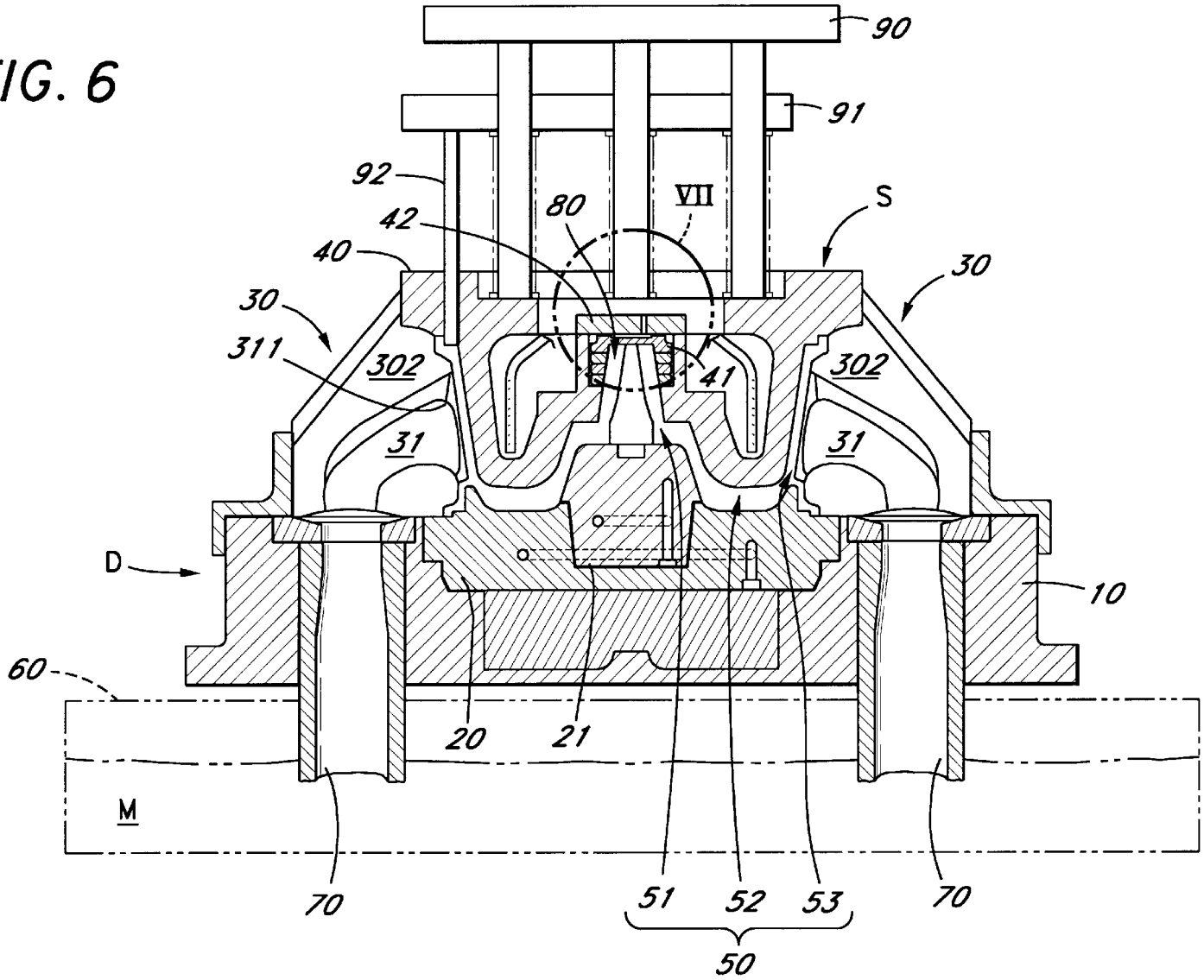
FIG. 6 is a sectional view of a pressure die-casting apparatus for a vehicle wheel constructed according to a fourth invention.
Figure 7:
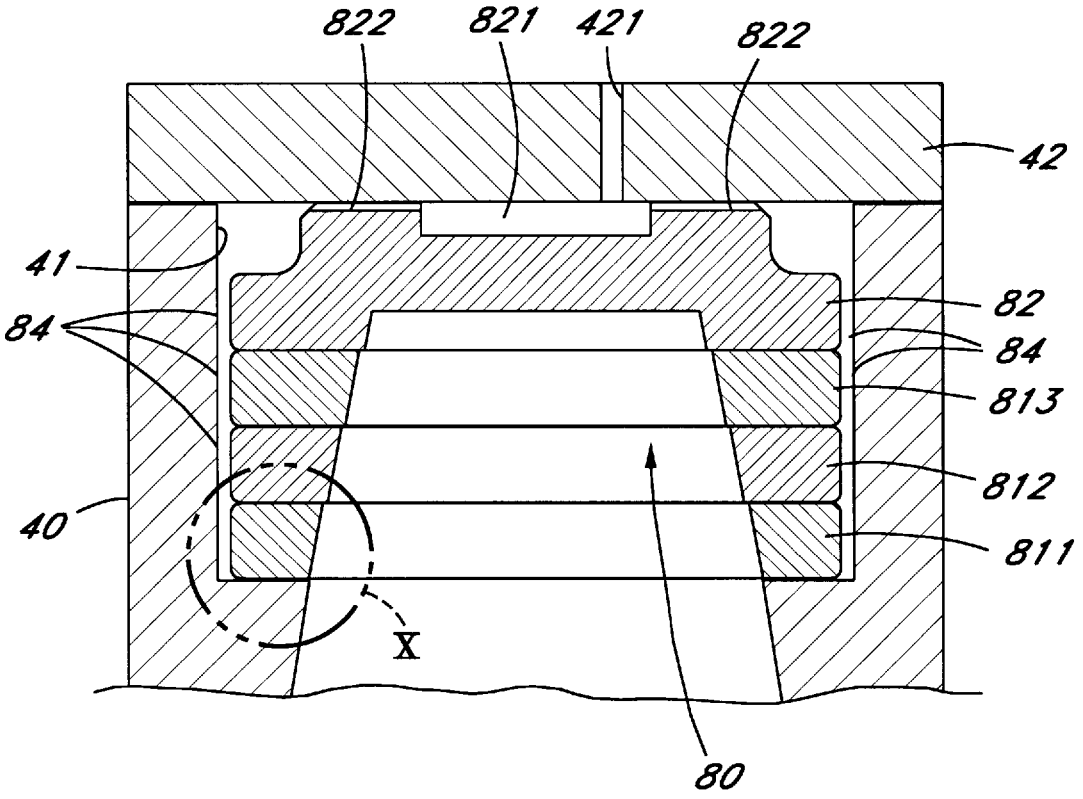
FIG. 7 is an enlarged sectional view of VII section in FIG. 6.
Figure 8:
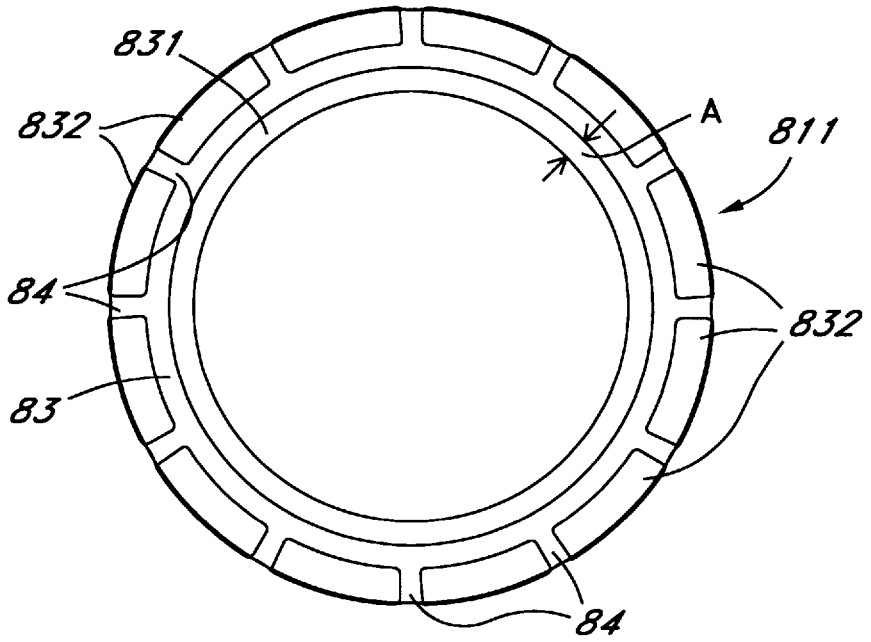
FIG. 8 is a plan view of an annular casting die member.
Figure 9:
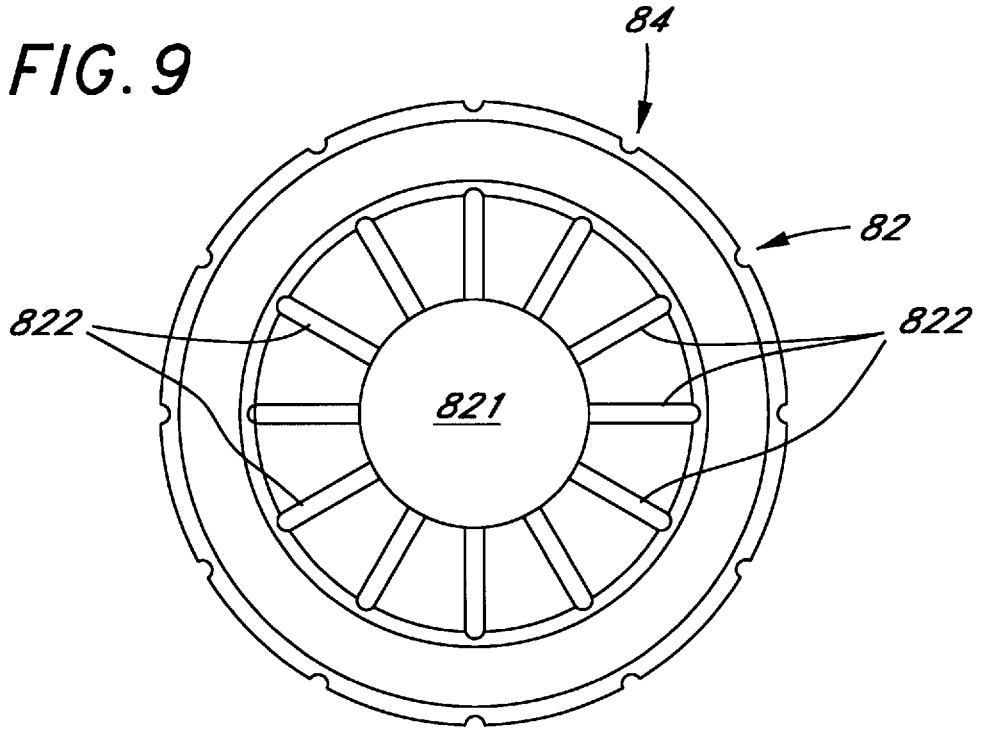
FIG. 9 is a plan view of a board-like casting die member.

In FIG. 6, reference numeral 80 denotes a dead head forming space which is disposed in the disc forming portion 51. As shown in FIG. 7 to FIG. 9, the dead head forming space 80 is formed by superimposing a plurality of annular casting die members 811, 812 and 813 one above another (corresponding to "dead head space constructing members" in the present invention) in a fitting hole 41 formed in the upper die in the inserted state and then placing a board like casting die member 82 (corresponding to "a dead head space constructing member" in this invention) on the top surface of the superimposed structure. The fitting hole 41 is covered with a lid 42, and a degassing hole 421 is formed through the lid 42.

Figure 10:
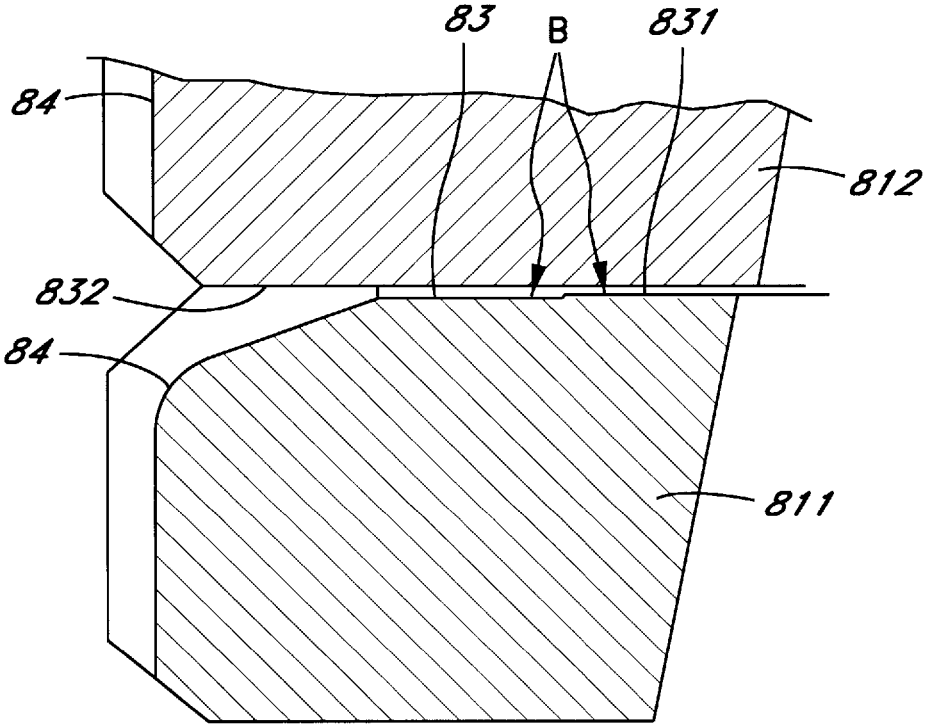
FIG. 10 is an enlarged sectional view of X section in FIG. 7.

In FIG. 8 and FIG. 10, reference numeral 83 denotes a peripheral grooves which are formed on the upper surface of the annular casting die member 811. Since an inner side portion 831 of the peripheral grooves 83 is located lower than an outer side portion 832, the outer side portion 832 provides a mating surface when the casting die member 812 is placed on the annular die-casting member 811 so that a gap B is formed between the peripheral groove 83 and the bottom surface of the casting die member 812 located adjacent to the inner side portion 831. It is desirable that the width of the gap B is set to 0.03 to 0.7 mm. When it is set to 0.03 mm or less, degassing is effected at a low efficiency, and when it is set to 0.7 mm or more, the molten metal is liable to invade in the gap. It is found that when it is set to about 0.2 mm, degassing is achieved at a highest efficiency.

In addition, when the width A of the inner side portion 831 is set to 10 to 30% of a radius of the annular die-casting portion 811, degassing is achieved at a highest efficiency while preventing invasion of the molten metal. It is found that when it is set less than 10%, the molten metal invades and when it is set in excess of 30%, degassing is achieved at a lower efficiency (due to an increased magnitude of resistance).

Reference numeral 84 denotes a recessed groove and is formed around the outer side portion 832 while extending in the radial direction. The recessed groove 84 is intended to conduct to the atmosphere the gas which passes through the gap B. The annular casting die member represented by reference numeral 811 has been described above and similar elements are provided in the other annular casting die members represented by other reference numerals 812 and 813.

Next, in FIG. 7 and FIG. 9, reference numeral 821 denotes a central recess, and reference numeral 822 denotes a recessed groove which radially extends from the recessed portion 821 and is formed on the board-like casting die member 82. The gas drawn from the dead head space 80 passes through the recessed groove 84, and thereafter, passes through the recessed grooves 822 to reach the central recess 821, and thereafter, it is discharged to the atmosphere through the degassing hole 421 of the lid 42.

Figure 11:
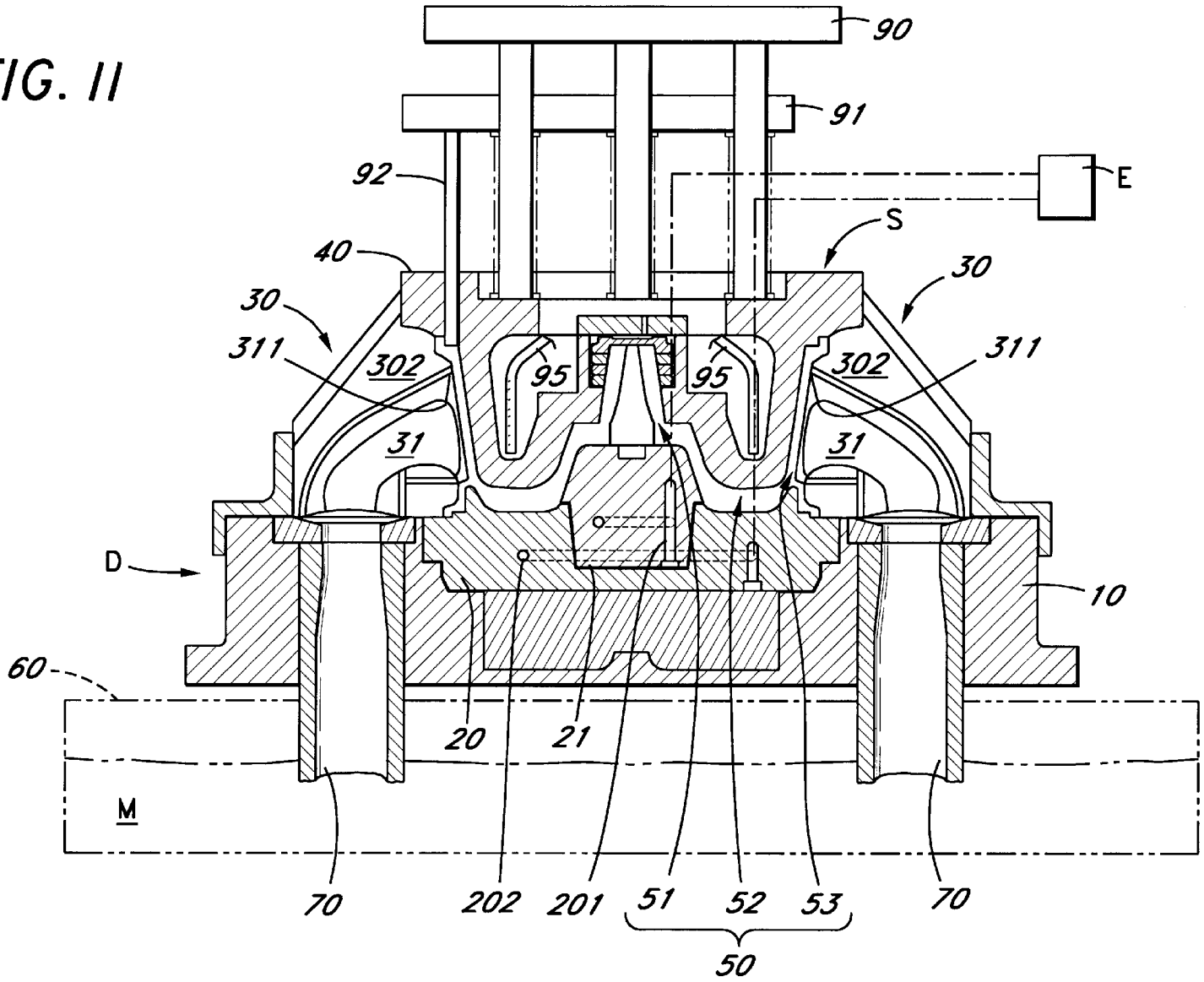
FIG. 11 is a sectional view of a pressure die-casting apparatus for a vehicle wheel constructed according to a fifth invention.
Figure 12:
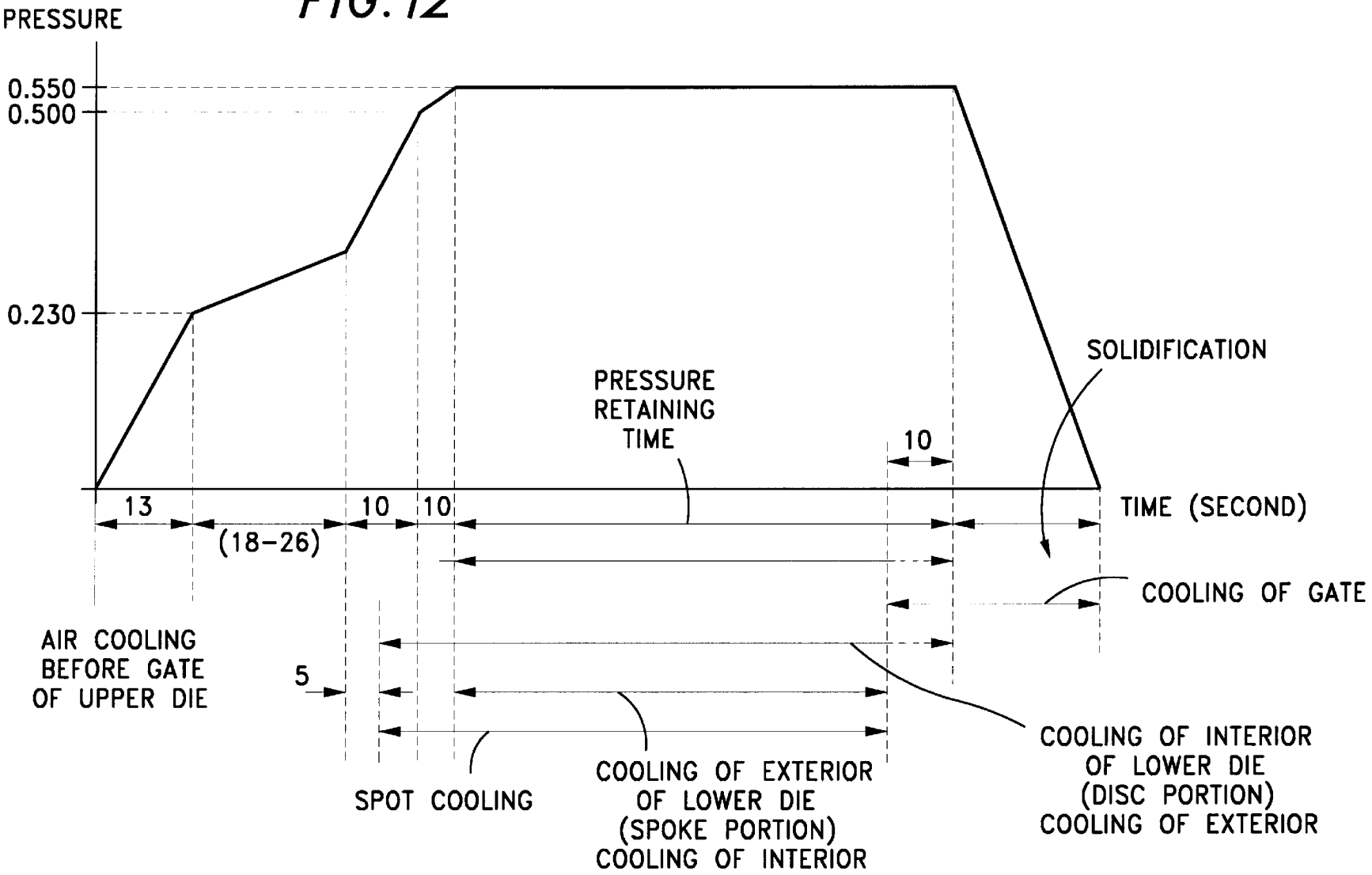
FIG. 12 is a controlling diagram of cooling means for the pressure die-casting apparatus constructed according to the fifth embodiment.

FIG. 11 and FIG. 12 shows an embodiment of a pressure die-casting apparatus for a vehicle wheel constructed according to the fifth invention.

In FIG. 11, reference numeral 201 denotes a first annular cooling passage (corresponding to "first cooling means") which is formed in the core 21 of the lower die 20. In addition, reference numeral 202 denotes a second annular cooling passage (corresponding to "second cooling means") which is formed in the lower die 20. The second cooling passage 202 surrounds the first cooling passage 201. Coolant flows through these cooling passages 201 and 202.

Reference numeral 95 denotes a cooling pipe which is disposed on the rear side of the upper die 40. The cooling pipe 95 serves to cool the upper die 40 by blowing cooling air from the nozzle at the foremost end of the cooling pipe 95 to the rear surface of the upper die 40.

Next, a method of controlling the cooling means will be described below with reference to FIG. 12.

First, a molten metal pressure is raised up to 0.230 at a constant pressurizing rate (pressurizing gradient) for 13 seconds so as to squeeze the molten metal to the top of the molten metal feeding tube 70.

Thereafter, while the pressurizing rate (pressurizing gradient) is lowered from the preceding one, pressure is applied for a required time (18 to 26 seconds). The time consumed at this time varies corresponding to the diameter of a wheel and the width of a rim. Namely, when the capacity of the molten metal is enlarged, the required time is elongated. After 5 seconds elapses from this time, the coolant starts to flow through either the first cooling passage 201 or the second cooling passage 202, the die temperature is detected by the cooling controlling means E, and the coolant continues to flow until a preset die temperature is reached. At the same time, spot cooling starts at the local heating portion, and the spot cooling is stopped before the pressure retaining state is terminated.

Thereafter, while the pressurizing rate (pressurizing gradient) is raised up such more than that at the preceding pressurizing time, molten metal is pressed for 10 seconds to that molten metal pressure is raised up to 0.500.

Thereafter, while the pressurizing rate (pressurizing gradient) is lower than that at the preceding pressurizing time, molten metal is pressed for 10 seconds so that molten metal pressure is raised up to 0.550. The reason why the dead head pressure is raised up by way of two stages consists in that since the molten metal feeding passage becomes narrow as time elapses at the time of molten metal feeding, there arises a necessity for maintaining the dead head effect by additionally pressing the molten metal. The pressure retaining state continues until an arbitrary time elapses. At this time, coolant starts to flow through either the second cooling passage 202 or the first cooling passage 201, and the die temperature is detected by the cooling controlling means so that the coolant continues to flow until the preset die temperature is reached. At the same time, the part located in front of the gate is air-cooled by the upper die 40 while the pressure retaining state is maintained.

Thereafter, the molten metal pressure is reduced to a level of zero at a constant pressure reducing rate (pressure reducing gradient). At this time, the gate continues to be air-cooled for ten seconds from the time when the molten metal pressure is reduced until the low pressure die is opened. It should be noted that the aforementioned numerals represent one example and vary depending on the length of the molten metal feeding pipe 70 and a quantity of molten metal. In other words, when a quantity of molten metal in the holding furnace 70 is reduced, causing the length to the head portion of the molten metal feeding pipe 70 to be enlarged, there arises a necessity for correcting (increasing) the pressurizing pressure. In addition, in case that a cast product becomes large and a quantity of molten metal is increased, the pressuring time and the cooling time are elongated.

INDUSTRIAL APPLICABILITY

As described above, the pressure-die casting apparatus of the present invention is advantageously useful as means for feeding molten metal using gas pressure.

We claim:

1. A casting apparatus for a vehicle wheel including a lateral die by which a rim forming portion for a cavity is constructed and having a molten metal feeding pipe located below said lateral die while standing substantially upright, characterized in that a flow passage changing runner is formed entirely on said lateral die, one end of said runner is opened at a rim forming portion of said cavity to serve as a gate, and the other end of said runner is directly communicated with said molten metal feeding pipe.

2. A casting apparatus having a runner space formed by a plurality of casting dies, comprising a rib forming space formed over substantially the whole length of and in communication with said runner space, and said rib forming space is formed in two directions along a parting surface of said casting dies.

3. A casting apparatus having a runner space formed by a plurality of casting dies, comprising a rib forming space formed continuously along and in communication with said runner space, said rib forming space being formed along a parting surface of said casting dies, and an auxiliary space expanded from said rib forming space formed along the foremost end edge of said rib forming space.

4. A pressure-die casting apparatus for a vehicle wheel, comprising:

a pair of lateral dies adapted to mate together at opposed parting surfaces and form a wheel-shaped cavity having an axis and including a rim forming portion;

an axially extending molten metal feeding pipe disposed below said wheel-shaped cavity and offset from said axis; and a molten metal flow passage runner formed between said lateral die parting surfaces in fluid communication with said rim forming portion, the runner extending generally radially outward from said rim forming portion and turning approximately ninety degrees downward to a lower opening portion terminating at a lower surface of said mated lateral dies;

wherein said lower opening portion is aligned with said molten metal feeding pipe to receive molten metal therefrom, and said runner providing an L-shaped flow passage defined entirely between said lateral dies to facilitate disconnection of a cast vehicle wheel from said die-casting apparatus.

5. The apparatus of claim 4, further including a lower die and an upper die, wherein the upper and lower die are adapted to mate together at opposed surfaces to define a disc forming portion and a spoke forming portion of said cavity, said upper die combining with said pair of lateral dies to define the rim forming portion.

6. The apparatus of claim 5, further including an actuating member for displacing the upper die axially with respect to the lower die, a wheel disconnect aperture formed axially in said upper die and opening to a top end of said rim forming portion, and a pin adapted to extend through the disconnect aperture into contact with the top end of the rim portion of a cast wheel to separate the wheel from the upper die.

7. The apparatus of claim 1, further including a sprue collar positioned between the lower opening portion of the runner and the molten metal feeding pipe, the sprue collar having an upper surface in the plane of the lower surface of the lateral dies and a central aperture through which molten metal flows from the molten metal feeding pipe to the runner, the sprue collar including a recess facing the lower surface of the lateral dies, the apparatus further including a strainer positioned in the recess and captured between the lower surface of the lateral dies and the sprue collar for straining the molten metal flow.

* * * * *